US008459072B2

(12) United States Patent
Bisson et al.

(10) Patent No.: US 8,459,072 B2
(45) Date of Patent: Jun. 11, 2013

(54) SECURITY COVER FOR A CYLINDER LOCK

(75) Inventors: Douglas Charles Bisson, Ancaster (CA); Todd Arnold Wayne Fielding, Burlington (CA)

(73) Assignee: Shred-It International Inc., Oakville, Ontario (CA)

( * ) Notice: Subject to any disclaimer, the term of this patent is extended or adjusted under 35 U.S.C. 154(b) by 0 days.

(21) Appl. No.: 12/547,944

(22) Filed: Aug. 26, 2009

(65) Prior Publication Data

US 2010/0162778 A1 Jul. 1, 2010

Related U.S. Application Data

(60) Provisional application No. 61/092,247, filed on Aug. 27, 2008.

(51) Int. Cl.
*E05B 17/18* (2006.01)

(52) U.S. Cl.
USPC ..... 70/455; 70/417; 70/423

(58) Field of Classification Search
USPC ..... 70/417, 419, 423, 453–455
See application file for complete search history.

(56) References Cited

U.S. PATENT DOCUMENTS

| | | | | |
|---|---|---|---|---|
| 3,343,386 | A * | 9/1967 | Hall | 70/423 |
| 3,444,712 | A * | 5/1969 | Greenwald | 70/423 |
| 3,903,721 | A * | 9/1975 | Aaron | 70/423 |
| 4,490,998 | A * | 1/1985 | Wellekens | 70/419 |
| 4,530,223 | A | 7/1985 | Oliver | |
| 4,638,652 | A * | 1/1987 | Morse et al. | 70/454 |
| 4,732,024 | A | 3/1988 | Nagy | |
| 4,873,853 | A | 10/1989 | Foshee | |
| 4,949,564 | A * | 8/1990 | Barzilai | 70/417 |
| 5,077,996 | A * | 1/1992 | Lien | 70/284 |
| 5,267,461 | A * | 12/1993 | Eizen | 70/451 |
| 5,400,628 | A * | 3/1995 | Ryan | 70/417 |

(Continued)

FOREIGN PATENT DOCUMENTS

| | | | |
|---|---|---|---|
| FR | 2552147 | A1 | 3/1985 |
| GB | 2141478 | A | 12/1984 |
| GB | 2257743 | A | 1/1993 |
| WO | 2005033449 | A1 | 4/2005 |

OTHER PUBLICATIONS

International Searching Authority, Patent Cooperation Treaty International Search Report, Form PCT/ISA/220, mailed on Dec. 8, 2009 in International Application No. PCT/CA2009/001196.

(Continued)

*Primary Examiner* — Suzanne Barrett
(74) *Attorney, Agent, or Firm* — Michael G. Johnston; Moore & Van Allen PLLC

(57) ABSTRACT

There is provided a security cover for a cylinder lock. The security cover may comprise a top wall and a peripheral side wall and may be adapted to be secured over an end of the lock and may include a key slot extending through the top wall and positioned to align with the lock cylinder when the cover is secured over the lock. There is also provided a key for use with the cover and a method for securing a cylinder lock.

9 Claims, 6 Drawing Sheets

U.S. PATENT DOCUMENTS

| | | | | |
|---|---|---|---|---|
| 5,502,991 | A | 4/1996 | Sornes | |
| 5,572,890 | A * | 11/1996 | Carpenter | 70/371 |
| 7,007,522 | B1 * | 3/2006 | Lee | 70/43 |
| 7,347,071 | B2 * | 3/2008 | Nakai et al. | 70/186 |
| 2006/0021403 | A1 | 2/2006 | Kuo | |
| 2007/0157687 | A1 * | 7/2007 | Bull et al. | 70/454 |

OTHER PUBLICATIONS

International Searching Authority, Patent Cooperation Treaty Written Opinion of the International Searching Authority, mailed on Dec. 8, 2009 in International Application No. PCT/CA2009/001196.

* cited by examiner

SECURITY COVER FOR A CYLINDER LOCK

BACKGROUND

1. Field

The subject matter disclosed generally relates to a security cover for a lock and to uses thereof.

2. Related Prior Art

A variety of lock and key designs and lock covers are known in the art. U.S. Pat. No. 4,732,024, to Nagy, issued Mar. 22, 1988, discloses a tube rigidly affixed to a lock cylinder in enclosing relation to the lock cylinder and an extended key for use therewith. US 2006/0021403 to Kuo, published on Feb. 2, 2006, discloses a burglar-proof lock comprising a cylinder case, a cylinder lock core and a key with thin shank. WO 2005/033449 to Qin, published on Apr. 14, 2005 discloses a lock comprising a lock body and an aperture for key inserting. FR2552147 to Doinel, published on Mar. 22, 1985 discloses a special key for a safety lock equipped with a keyhole having a mobile hiding plate.

SUMMARY

In a first embodiment there is disclosed a security cover for a cylinder lock. The security cover may comprise a top wall and a peripheral side wall and may be adapted to be secured over an end of the lock and may include a key slot extending through the top wall and positioned to align with the lock cylinder when the cover is secured over the lock. In alternative embodiments, the key slot may comprise first and second intersecting slots. The slots may intersect at an angle of about 90 degrees. The first slot may correspond with an open position of the lock and the second slot may correspond with a closed position of the lock. The cover may be a metal cover. The peripheral side wall may have an end and the distance between the end and the top wall may be between about 0.5 cm long and about 2 cm. When the cover is mounted over the lock then the top wall may be less than about 2 cm from the lock.

In alternative embodiments, there is disclosed a key for a cylinder lock having a security cover. The key may comprise a bow and a blade with a neck and may be sized to allow the key to freely rotate when inserted through the cover into the lock. In alternative embodiments, of the key the blade may comprise a spacer portion and the spacer portion may be less than about 2.0 cm long.

In alternative embodiments there is disclosed a method for securing a cylinder lock. The method may comprise providing a security cover for the lock. The security cover may comprise a top wall and a peripheral side wall. The top wall may include a key slot and the cover may be adapted to be secured over the end of the lock. The method may further comprise providing a key may have a bow, an extended blade and a neck proximate the bow, so that the key may be able to freely rotate when inserted through the cover into the lock. In alternative embodiments the security cover may be secured over the lock with the key slot in alignment with the cylinder of the lock and the top wall may be between about 0.5 cm and 2 cm from the lock when the cover is secured over the lock.

In alternative embodiments there is disclosed a kit for securing an existing cylinder lock which may comprise a top wall and a peripheral side wall and may be adapted to be secured over an end of the lock and may include a key slot extending through the top wall and positioned to align with the lock cylinder when the cover is secured over the lock; a key which may comprise a bow and a blade with a neck and sized to allow the key to freely rotate when inserted through the cover into the lock; and instructions to use the cover and the key to secure a cylinder lock, In alternative embodiments there is disclosed a metal security cover for a cylinder lock. The security cover may comprise a top wall; a peripheral side wall which may have an end and the distance between the end and the top wall is between about 0.5 cm and about 2 cm, a key slot extending through the top wall and may comprise first and second intersecting slots, and the first slot may correspond with an open position of the lock and the second slot may correspond with a closed position of the lock. The key slot may be positioned to align with the lock cylinder when the cover is secured over the lock, and the cover is adapted to be secured over an end of the lock.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

DETAILED DESCRIPTION OF THE PREFERRED EMBODIMENTS

Figure 1:
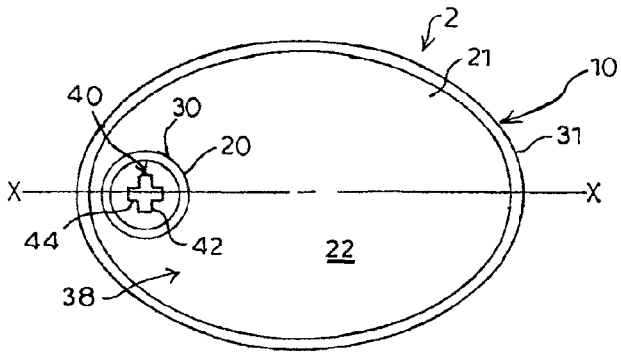
FIG. 1 is a front view of a security cover according to an embodiment.
Figure 2:
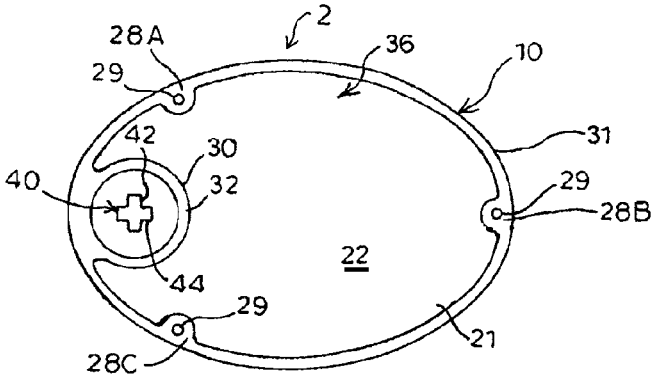
FIG. 2 is a rear view of the security cover of FIG. 1.
Figure 3:
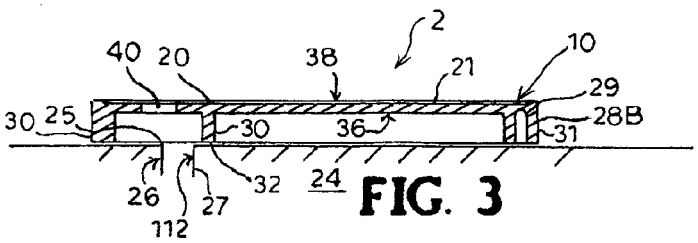
FIG. 3 is a cross sectional view of the security cover of FIG. 1, taken along line x-x of FIG. 1
Figure 4:
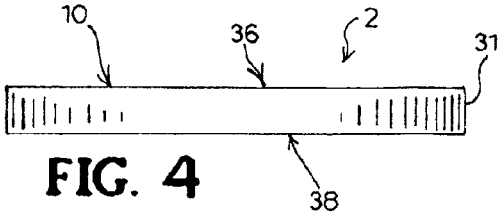
FIG. 4 is a side view of the security cover of FIG. 1.
Figure 5:
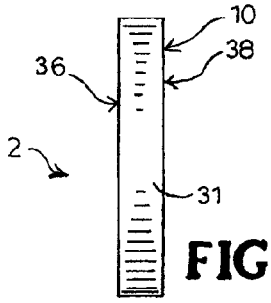
FIG. 5 is an end view of the security cover of FIG. 1.
Figure 6:
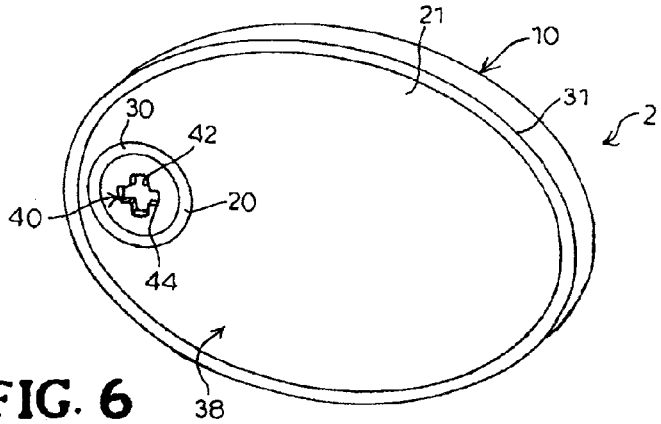
FIG. 6 is a perspective front view of the security cover of FIG. 1.
Figure 7:
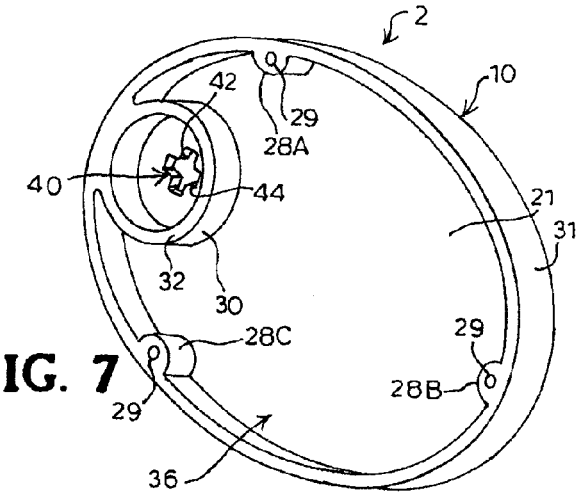
FIG. 7 is a perspective rear view of the security cover of FIG. 1.
Figure 8:
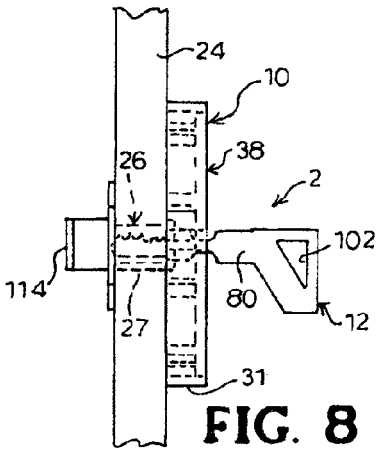
FIG. 8 is a cross section view of a security cover according to FIG. 1, mounted on a door.
Figure 10:
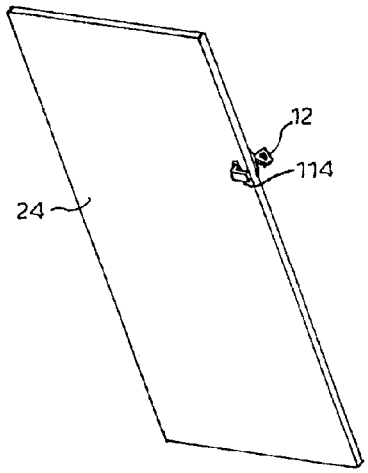
FIG. 10 is a rear view of an installation according to FIG. 9
Figure 9:
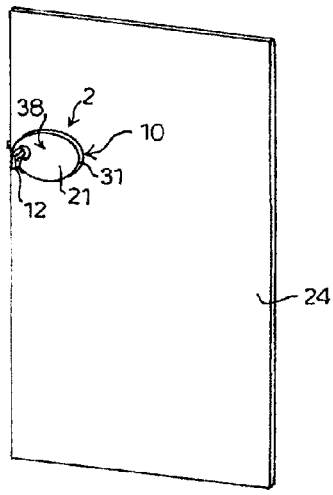
FIG. 9 is a front view of a security cover mounted on a door
Figure 15:
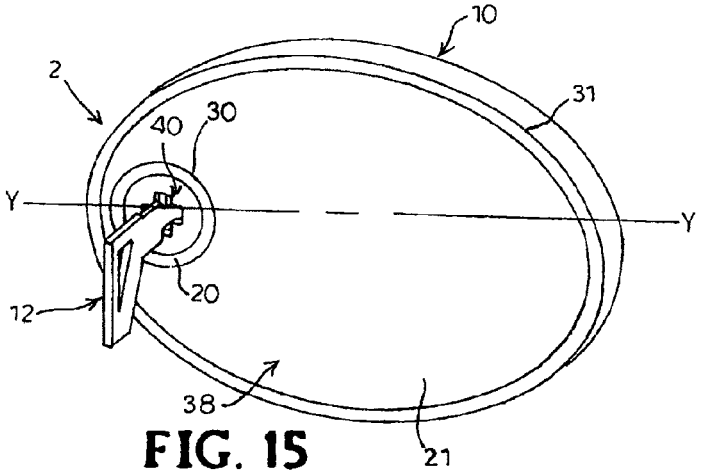
FIG. 15 is a detailed perspective view of a security cover according to an embodiment with an inserted key.
Figure 16:
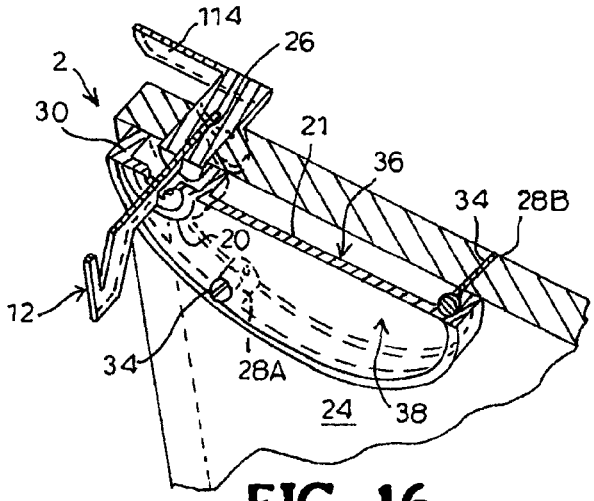
FIG. 16 is a cutaway perspective view of a cooperating key and security cover of an embodiment, and mounted on a door.

In embodiments there are disclosed a security cover for a cylinder lock, a key for use therewith and a method for securing a lock. The first embodiment is generally designated 2 and is described with reference to FIGS. 1 through 17. The first embodiment 2 may comprise a lock cover 10 and key 12 for use therewith. As will be seen, the cover 10 comprises a top wall 20 and peripheral side wall 30. The top wall 20 may be continuous with or may be accompanied by an extension 22. Cover 10 may be adapted to be secured to a mounting surface 24 over the end 25 of a cylinder lock 26. The cover 10 may comprise securing points 28, which may be holes for securing means 34 which may be screws. In the illustrated embodiment three such securing points 28A, B and C are provided but it will be understood that other numbers of securing points may be suitable and in alternative embodiments 1, 2, 3, 4, 5, 6, 7, 8, 9, 10 or any other number of securing points may be used. In some embodiments the channels of securing means may open to the front surface of the cover 10, as illustrated in FIG. 16, but in alternative embodiments such as that illustrated in FIGS. 1 and 15, the holes may not have openings on the front of the cover or such openings may be covered or coverable. The cover 10 may be securable to a door 24, or other suitable mounting surface, which may be a console door and may be secured using any conventional securing means such as screws, bolts, adhesives, screw on threads, clips, bands, staples, or a range of other alternatives all of which will be readily understood and implemented by those skilled in the art. Where desired securing points 28A, B and C may be recessed or may be adapted in a range of ways to enhance the security of the attachment of the cover 10 to the substrate 24 by preventing the removal of securing screws and the like and may comprise channels 29 to permit the use of screws 34 and the like to affix the cover 10 to a substrate 24.

The top wall 20 may comprise a key slot 40 extending through the top wall and in the illustrated embodiment the key slot 40 may comprise more than one intersecting slots, which may be or may comprise first and second intersecting slots 42, 44 and may intersect at an angle of about 90 degrees. In alternative embodiments there may be only one slot, or there may be three, four, five or more intersecting slots or alternative geometrical configurations may be adopted. Similarly where the slot 40 comprises two or more intersecting slots they may intersect at any suitable angle, which may be between about 0 and 30 degrees, between about 30 and 60 degrees, between about 60 and 90 degrees, between about 90 and 120 degrees, between about 120 and 150 degrees, between about 150 and 180 degrees, between about 180 and 210 degrees, between about 210 and 240 degrees, between about 240 and 270 degrees, between about 270 and 300 degrees, between about 300 and 330 degrees and up to between about 330 and 360 degrees. The first slot 42 and second slot 44 may respectively correspond with open and closed positions of the lock 26 but it will be understood that in alternative embodiments a plurality of intersecting slots may be comprised in slot 40 and these may correspond to selected alternative positions of the lock 26 or key 12.

In alternative embodiments parts or all of the cover 10 may comprise metals, plastics, resins, ceramics or any other suitable materials, all of which will be readily identified, selected among and used by those skilled in the art. In the embodiment illustrated the peripheral side wall 30 may have an end 32 distal to the top wall 20 and the distance between the end 32 and the top wall 20 may be between about 0.5 cm and about 2.0 cm. In embodiments extension 22 may form a part of or merge with edge 31 which may be thickened or may comprise a further bounding wall. In embodiments the plate 21 of extension 22 may be recessed at one or more of the back and front of the cover as will be seen in FIG. 6 and FIG. 7. In an embodiment peripheral wall 30 and edge 31 may be fused to form a unitary structure but it will be apparent that this is optional and the two may be separate. In the embodiment illustrated the key slot 40 and its associated structures are positioned at one end of the cover 10 so that when the cover is in use the key slot 40 can be positioned over a lock 26 proximate the edge of a door or other structure but in alternative applications this may be unnecessary or undesirable. When the cover 10 is secured over a lock 26 then the top wall 20 may be less than about 2.0 cm from the end 25 of lock 26. In alternative embodiments the distance between end 32 and top wall 20 may be of any suitable value, and when the cover 10 is mounted over an end of a lock 26 the distance between end wall 20 or key slot 40 and end 25 of lock 26 may of any suitable value. Such suitable values for the distance between lock end 25 and top wall 20 or key slot 40 may be between about 0 and 0.5 cm, between about 0.5 and 1.0 cm, between about 1.0 and 1.5 cm, between about 1.5 and 2.0 cm, between about 2.0 and 2.5 cm, between about 2.0 and 2.5 cm, between about 2.5 and 3.0 cm, between about 3.0 and 3.5 cm, between about 3.5 and 4.0 cm, between about 4.0 and 4.5 cm, between about 4.5 and 5.0 cm, between about 5.0 and 5.5 cm, between about 5.5 and 6.0 cm, between about 6.0 and 6.5 cm, between about 6.5 and 7.0 cm, between about 7.0 and 7.5 cm, between about 7.5 and 8.0 cm, between about 8.5 and 9.0 cm, between about 9.0 and 9.5 cm, between about 9.5 and 10.0 cm or may be greater than about 10 cm. In embodiments top wall 20 with its surrounding peripheral wall 30 may stand proud of the extension plate 21 as seen from front 38 and back 36 of the cover, for example in alternative embodiments such as that shown in FIG. 15 and as will be seen in the cross section of FIG. 3, the front 38 may be flat and the peripheral wall 30 may not be visible to a user seeing it from the front 38. It will be appreciated that the positioning of the key slot 40, along with the shape, size and all other features of the cover may be adapted to suit particular applications so long as the claimed features of the embodiments are preserved. The peripheral wall 30 may be continuous or discontinuous and in embodiments may not fully enclose top wall 20. In embodiments it may also serve as the edge wall 31 or a part thereof. If will be appreciated that a range of possible configurations and constructions may be suitable to hold the top wall 20 in its desired position and permit any necessary securing of the cover 10 to a substrate 24. All of these will be readily identified and implemented by those skilled in the art.

Figure 11:
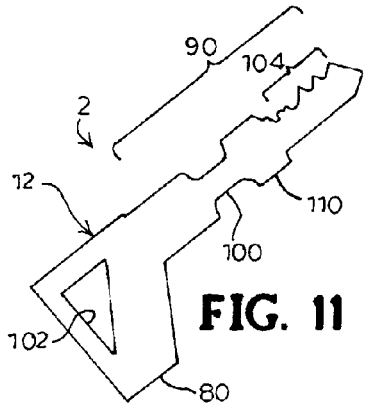
FIG. 11 is a perspective view of a key according to an embodiment.
Figure 13:
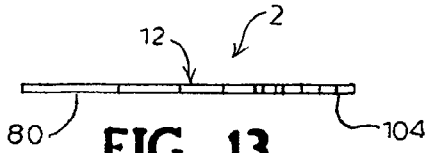
FIG. 13 is a longitudinal edge view of the key according to FIG. 11
Figure 14:
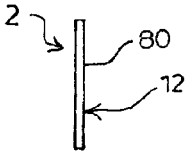
FIG. 14 is an end view of the key according to FIG. 11
Figure 12:
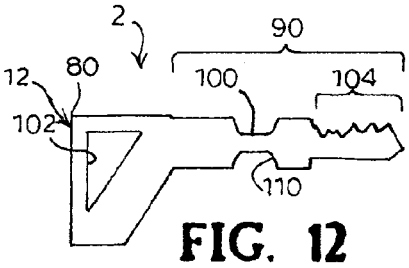
FIG. 12 is a side view of the key according to FIG. 11

Referring to FIGS. 11 and 12, a key 12 comprises a bow 80 and a blade 90. The bow may comprise an opening or other structures, generally designated 102 for securing the key to a wallet or other structure or for ornamental purposes. The blade 90 may comprise a spacer 110 and actuating portion 104. Spacer 110 may serve to establish suitable relative distancing of neck 100 from actuating portion 104. The length of the spacer may be less than 2.0 cm, for example, between about 0.5 and 2.0 cm. The blade may also comprise a neck 100. The neck is proximate the bow 80 and is sized to allow the key to freely rotate when inserted through the key slot 40 of cover 10 into the lock 26. In alternative embodiments, the distance between the neck and the lock may be between about 0.5 and 2.0 cm, may be between about 0 and 0.5 cm, between about 0.5 and 1.0 cm, between about 1.0 and 1.5 cm, between about 1.5 and 2.0 cm, between about 2.0 and 2.5 cm, between about 2.0 and 2.5 cm, between about 2.5 and 3.0 cm, between about 3.0 and 3.5 cm, between about 3.5 and 4.0 cm, between about 4.0 and 4.5 cm, between about 4.5 and 5.0 cm, between about 5.0 and 5.5 cm, between about 5.5 and 6.0 cm, between about 6.0 and 6.5 cm, between about 6.5 and 7.0 cm, between about 7.0 and 7.5 cm, between about 7.5 and 8.0 cm, between about 8.5 and 9.0 cm, between about 9.0 and 9.5 cm, between about 9.5 and 10.0 cm or may be greater than about 10 cm.

In alternative embodiments, the key may comprise any suitable materials and may comprise metals. A range of suitable materials will be readily identified, selected among and used by those skilled in the art.

Figure 17:
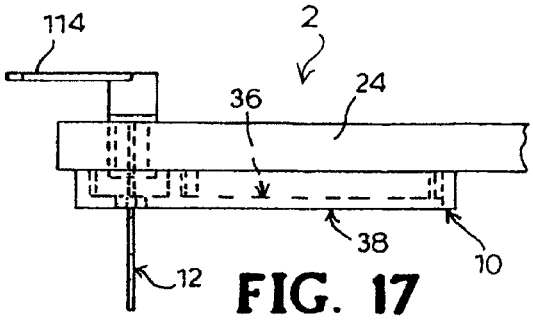
FIG. 17 is a cross sectional view of a lock security cover and key according to FIG. 16.

In use, as will be seen from FIGS. 16 and 17 cover 10 may be secured over a lock 26 suitably positioned so that slot 40 is aligned with keyhole 102 in cylinder 27 of lock 26 to allow a suitable key 12 to be inserted through slot 40 so that when actuating portion 104 of key 12 is inserted into keyhole 102 of cylinder 26, then neck 100 is positioned in key slot 40 so that key 12 may be rotated to actuate the lock 26 and then withdrawn through slot 40. In use the key 12 may be inserted through first slot 42 and rotated to actuate lock 26 and may then be withdrawn through second slot 44. In the embodiment illustrated, the lock 26 has open and closed positions determined by the disposition of securing member 114 and respectively actuated in rotation state of key 12 that correspond with one of the first and second slots 42, 44.

In the embodiment illustrated, the cover 10 and lock 26 are mounted to a console door 24, which may be the door to a shredding cabinet or other storage unit. It will be understood however that the embodiments disclosed and claimed could equally be used to secure any type of securable structure using a cylinder lock.

In an alternative embodiment there is disclosed a kit for securing an existing cylinder lock. The kit may comprise a security cover according to an embodiment, or a key according to an embodiment or a security cover and key according to an embodiment, along with suitable instructions to use the cover and the key to secure a cylinder lock.

The embodiments and examples presented herein are illustrative of the general nature of the subject matter claimed and are not limiting. It will be understood by those skilled in the art how these embodiments can be readily modified or adapted for various applications and in various ways without departing from the spirit and scope of the subject matter disclosed claimed. The claims hereof are to be understood to include without limitation all alternative embodiments and equivalents of the subject matter hereof. Phrases, words and terms employed herein are illustrative and are not limiting. Where permissible by law, all references cited herein are incorporated by reference in their entirety. It will be appreciated that any aspects of the different embodiments disclosed herein may be combined in a range of possible alternative embodiments, and alternative combinations of features, all of which varied combinations of features are to be understood to form a part of the subject matter claimed.

The invention claimed is:

1. A security cover for a cylinder lock having a key slot, said security cover comprising a top wall and a peripheral side wall and adapted to be secured over an end of the lock, said top wall defining a key slot extending through said top wall and positioned to align with the key slot of the lock cylinder when said cover is secured over the end of the lock, said key slot having a first intersecting slot corresponding with a closed position of the lock and a second intersecting slot, said first and second intersecting slots substantially forming a cross such that the key slot has four positions of withdrawal for a key, the four positions of withdrawal spaced over 360 degrees from the first intersecting slot.

2. The security cover according to claim 1 wherein said slots intersect at an angle of about 90 degrees.

3. The security cover according to claim 1 wherein said cover is a metal cover.

4. The security cover according to claim 1 wherein said peripheral side wall has an end and the distance between said end and said top wall is between about 0.5 cm and about 2 cm.

5. The security cover according to claim 1 wherein, when said cover is mounted over the lock then said top wall is less than about 2 cm from the lock.

6. The security cover according to claim 1, further comprising a key, said key comprising a bow and a blade with a neck between the bow and the blade, the neck being narrower than the blade and sized to allow said key to freely rotate when inserted through the cover into the lock such that said key can be inserted into the lock through one of said intersecting slots and rotated to actuate the lock, and said key can be withdrawn through said second of said intersecting slots.

7. The key according to claim 6 wherein said blade comprises a spacer portion and said spacer portion is less than about 2.0 cm long.

8. A method for securing a cylinder lock including a key slot, said method comprising the steps of:

a) providing a security cover, said security cover comprising a top wall and a peripheral side wall, said top wall defining a key slot having first and second intersecting slots, said first and second intersecting slots substantially forming a cross such that the key slot has four positions of withdrawal for a key, the four positions of withdrawal spaced over 360 degrees from the first intersecting slot;

b) securing said security cover over the end of the cylinder lock with said first and second intersecting slots in alignment with the key slot of the cylinder lock;

c) providing a key having a bow, an extended blade and a neck between said bow and said blade, said neck being narrower than said blade and sized so that when said key is inserted into the lock said neck is aligned with said top wall so that said key is able to freely rotate when inserted through the cover into the lock;

d) inserting said key into the key slot of the lock cylinder through one of said first and second intersecting slots;

e) rotating said key to actuate the lock; and f) withdrawing said key through one of said intersecting first and second slots.

9. The method according to claim 8 wherein said top wall is between about 0.5 cm and 2 cm from the lock when said cover is secured over the lock.

* * * * *